US006029645A

United States Patent [19]

Wonisch et al.

[11] Patent Number: 6,029,645

[45] Date of Patent: Feb. 29, 2000

[54] PRESSURE-OPERATED FIREARM

[75] Inventors: Franz Wonisch; Dietmar Emde, both of Arnsberg, Germany

[73] Assignee: Umarex Sportwaffen GmbH & Co, KG, Arnsberg, Germany

[21] Appl. No.: 09/068,691

[22] PCT Filed: Sep. 21, 1996

[86] PCT No.: PCT/EP96/04131

§ 371 Date: May 14, 1998

§ 102(e) Date: May 14, 1998

[87] PCT Pub. No.: WO97/18432

PCT Pub. Date: May 22, 1997

[30] Foreign Application Priority Data

Nov. 14, 1995 [DE] Germany ..... 195 42 326

[51] Int. Cl.[7] ..... F41B 11/00

[52] U.S. Cl. ..... 124/74

[58] Field of Search ..... 124/74, 71, 70, 124/61, 60, 57; 42/87

[56] References Cited

U.S. PATENT DOCUMENTS

| | | | |
|---|---|---|---|
| 3,207,143 | 9/1965 | Kline et al. | 124/11 |
| 3,527,194 | 9/1970 | Vadas et al. | 124/11 |
| 3,788,298 | 1/1974 | Hale | 124/11 R |
| 3,999,534 | 12/1976 | Chapin et al. | 124/74 |
| 4,344,410 | 8/1982 | Curran | 124/80 |
| 5,622,160 | 4/1997 | Casas Salva | 124/76 |

FOREIGN PATENT DOCUMENTS

| | | |
|---|---|---|
| 1114121 | 9/1961 | Germany . |
| 2752446 | 8/1978 | Germany . |

*Primary Examiner*—Charles T. Jordan
*Assistant Examiner*—Jeffrey Howell
*Attorney, Agent, or Firm*—Scully, Scott Murphy & Presser

[57] ABSTRACT

The invention discloses a compressed gas-operated pistol (1) with a gas capsule (15) arranged in a grip member (5), which is in operative connection with a valve system (33) of the pistol (1). The secure receipt and piercing of the gas capsule (15) is effected through an abutment (17) which completes an inherent displacement and an external displacement superimposed on this inherent displacement. The external displacement is thereby effected by a support element (23) of the abutment (17) which is contacted by capsule tensioner (25). (FIG. 2).

8 Claims, 4 Drawing Sheets

PRESSURE-OPERATED FIREARM

BACKGROUND OF THE INVENTION

1. Field of the Invention

The invention relates to a compressed gas-operated firearm which incorporates a gas capsule or gas cartridge insertable into a chamber formed in a grip member of the firearm.

2. Discussion of the Prior Art

Through the disclosure of U.S. Pat. No. 4,344,410 there is already known a hand-held firearm in the type of class in which the grip member or handgrip has a gas cartridge or gas capsule insertable therein. For this purpose, the grip member possesses an outwardly pivotable cover with a deformation into which a gas cartridge is insertable. Through the closing of the cover, the gas cartridge is brought into its final position in which the upper closure is pushed upwardly through a valve arrangement which is built into the firearm. As a result thereof, the gas is withdrawn from the gas cartridge and conducted through the valve system to the firearm for the emission of a shot.

The described arrangement for the receipt of a gas cartridge in the grip member of a hand-held firearm is a fixed system which, in principle, does not permit any tolerances for the gas cartridge. The gas cartridge is brought into its final position in a single pivoting movement of the cover, whereby no consideration is given as to whether the gas cartridge has been correctly inserted, whether it possesses the correct precisely-fitted dimensions, and whether it has been canted during the inward pivoting movement of the cover. All of these unconsidered, and from exteriorly not foreseeable sequences can lead to damaging of the gas cartridge and for a reduced firing capability of the firearm.

From the disclosure of German DE 27524446 A1, there is presently known a so-called gas capsule penetrating arrangement for the compressed gas-operated firearm. This arrangement is described on the basis of a rifle and is not directed to a pistol or the like hand-held firearm. Within the framework of the rifle, there is located a chamber extending in parallel with the barrel in a longitudinal direction for the receipt of a gas capsule, and which is closed by a lever which is downwardly outwardly pivotable. This lever is configured in a fork shape at its short lever arm, whereby the effective circumferential surfaces possess cams and flattened surface portions which act on a block consisting of rods and annular disks with shoulders. The entire block stands under the force of a spring acting in a direction towards an opening movement of the block, and thereby away from the gas cartridge. As a result, in cooperation with the cams and flattened surfaces of the short lever arm, after exceeding the piercing open position, there is achieved a slight unstressing in the axial direction of the gas cartridge. In this end or final position, in which the lever is fully swung in below the weapon and the chamber is closed, the gas can escape from the gas cartridge into a valve system connected to the outlet thereof.

By means of this described arrangement, there are already compensated any tolerances of the gas cartridge in the final position, and obtained is a constantly more effective higher pressure for the gas cartridge and for the valve system. Nevertheless, this arrangement is also subject to the not foreseeable position of the gas cartridge in the final position as well as in interim positions. Through the inward pivoting of the cover by the immediately and without any tolerance acting lever system, there cannot be precluded any erroneous handling and damaging of the gas cartridge.

SUMMARY OF THE INVENTION

Commencing from the above mentioned state of the technology, it is an object of the invention to propose a compressed gas-operated firearm of the above-described type, which facilitates the receipt of a gas cartridge through the intermediary of simple technological means, affords an optimum tolerance compensation, and in the interim positions as well as in the final position of the inserted gas capsule allows for an overview thereof.

The essential concept in the solution to the problem consist of in that the receipt of the gas capsule and the insertion up to its final position is undertaken independently of the closure arrangements for the receiving chamber of the gas capsule. As a result thereof, there can be foreseen all positions of the gas capsule in an optimum manner, and can be already corrected prior to any possible damage to the capsule. On the other hand, there is achieved a protective handling of the gas capsule at optimum interim and final positions, and also larger tolerances of the gas capsule are compensated for without any problems.

The abutment which is opposite and facing away from tip of the gas capsule which is to be pierced is axially displaceable relative to a support element for the abutment to such an extent as to afford a comfortable insertion of the gas capsule in the correct position into the receiving chamber of the firearm. The relative movement of the abutment facilitates thereafter an axial displacement into a secure and operationally correct position of the gas capsule, without that the latter is already pierced. The piercing of the tip of the gas capsule is only first effected upon the external displacement which is superimposed upon the inherent displacement of the abutment, which proceeds from the support element, and transmits itself to the gas capsule through the abutment. This external displacement itself is undertaken by a tensioning device which acts on the support element of the abutment.

BRIEF DESCRIPTION OF THE DRAWINGS

Further advantageous details are more closely elucidated on the basis of the following description of the figures.

In the drawing, there is illustrated an example of the invention, wherein.

DETAILED DESCRIPTION OF A PREFERRED EMBODIMENT

Figure 1:
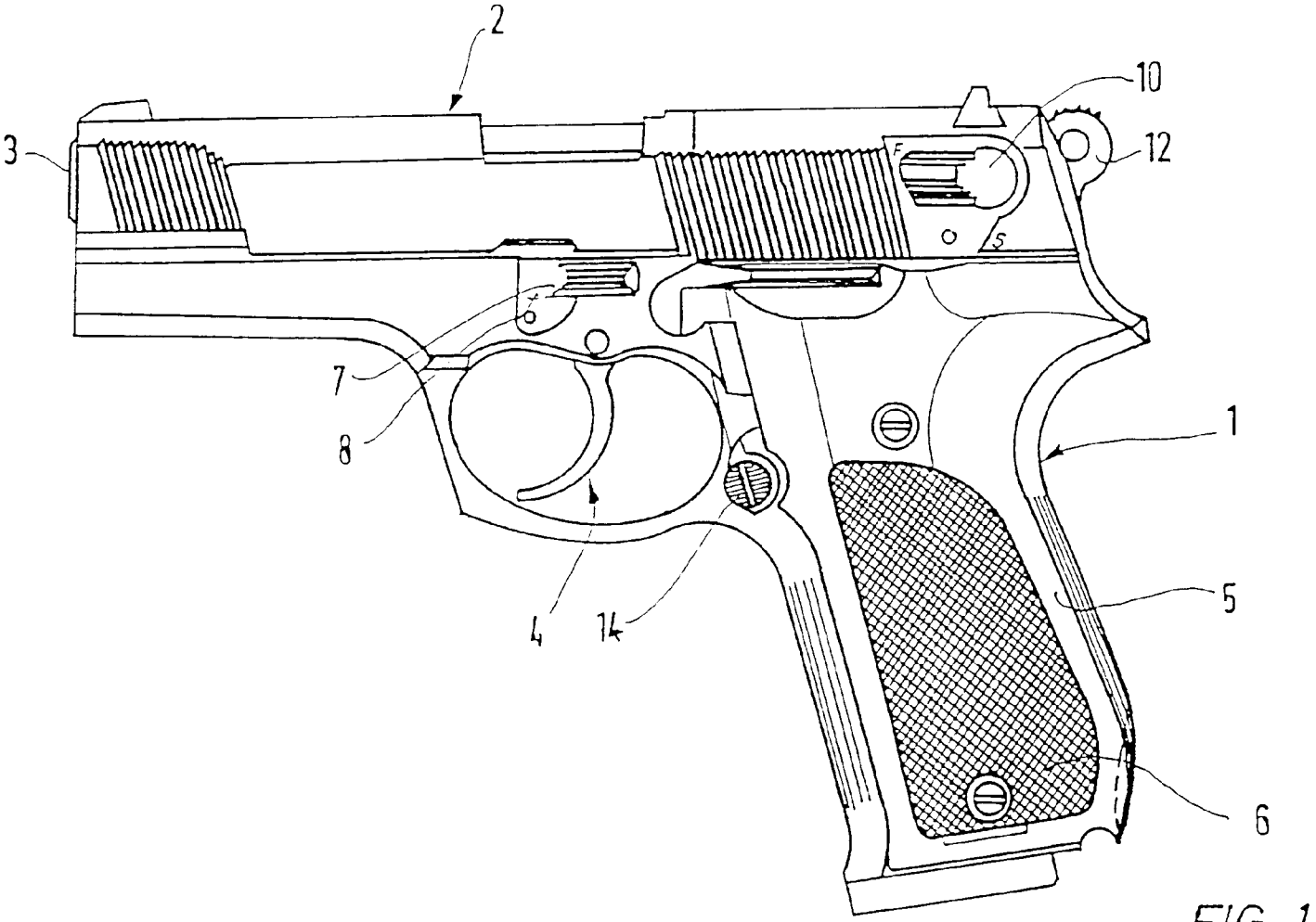
FIG. 1 illustrates a side view of a compressed gas-operated firearm.

The compressed gas-operated firearm, for example, a pistol 1 consist essential of the breech block or frame 2, the barrel 3 which is arranged on or in the frame 2, the trigger 4 and the handpiece or grip member 5. The barrel 3 is linearly slidable within the frame 2 from a firing position into a loading position, and conversely. The unlatching of the barrel 3 and its linear displacement which is supported by a spring force is effected by a locking lever 7 which, through pivoting thereof about an axis 8, produces the latched or unlatched position.

The actual securing of the firearm 1 is effected by a safety lever 10, which in the illustrated position, brings a striker or firing pin 11 into the line of action between the hammer or cock 12 and a valve stem 13 of a valve system 33, which corresponds to the firing position "F". The manual swinging over of the safety lever 10 downwardly into the secured position "S" rotates the firing pin 11 out of the described line of action, as a result of which there is prevented any release or firing of a shot.

The grip member 5 possesses a forward grip cup or shell 6 which can be opened by the actuation of a knob 14 of the grip cup, and manually removed from the grip member 5. Through the knob 14 of the grip cup there is actuated, in a simple manner, for example, a spring-supported latching mechanism which is known per se, which facilitates the removal of the grip cup 6 upon application of an inward pressing force, and permits a snapping in upon the application of the grip cup 6.

At a view into the interior of the grip member 5, for example, at a removed grip cup 6, there is ascertainable a chamber 9 into which a gas capsule or gas cartridge 15 is loosely insertable at an axial play both upwardly and downwardly. The spherical or ball-shaped bottom surface 16 of the gas capsule 15 is located at an axial spacing from the bearing or abutment support 17 in a form of a knurled-head screw 20, The abutment support 17 has a central receiving surface 18 for the bottom surface 16 of the gas capsule 15, which is provided with a spherical, concave or the like recess 19, as a result of which the gas capsule is securely received on the bottom. The receiving surface 18 corresponds with the surface of the knurled-head screw 20; the unitary screwthreaded pin 21 of which is screwed into a screwthreaded bore 22 of a support element 23.

Figure 2:
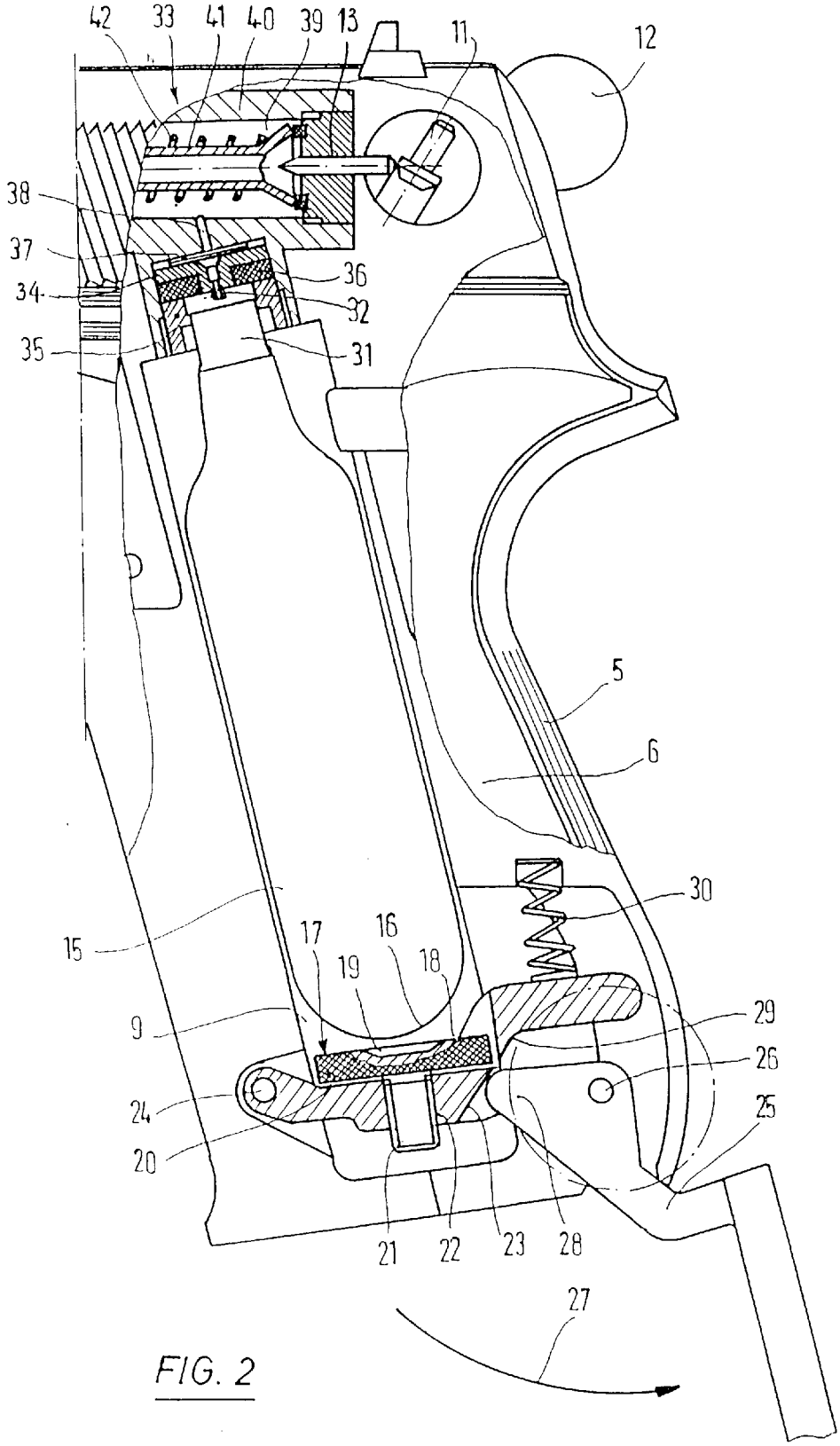
FIG. 2 illustrates the opened grip element of the firearm pursuant to FIG. 1, with the loading position of the abutment shown in cross-section.

The support element 23 is constructed as a single-armed lever which is retained in a grip element 5 so as to be pivotable about the axis 24. The support element 23 possess a flat middle surface on which there is supported the abutment 17 in its opened end position, or almost lies thereon, as is illustrated in FIG. 2. Extending from the middle surface is a stepped configuration, which is contacted on the lower side by a capsule tensioner 25. The capsule tensioner 25 is supported so as to be pivotable about the axial bolt 26, and in FIG. 2 assumes the fully opened position after rotation in the direction of arrow 27. In this illustrated position, the short lever arm 28 of the capsule tensioner 25 lies against the lower inclined surface 29 of the stepped configuration.

A spring 30 which is inserted into the grip member 5 stands on the upper side of the support element 23 in the end region thereof, and presses the latter into the opened position pursuant to FIG. 2.

The tip 31 of the gas capsule 15 is located at an axial spacing from the piercing pin 32 of the valve system 33. The piercing pin 32 is inserted into a piercing disk 34, which is sealing retained relative to the gas capsule 15 in a piercing housing 35 through a sealing disk 36. Above the sealing disk 36 there is provided a screen 37 which is located in front of the gas passageway 38 which connects into the valve chamber 39 of the valve housing 40. In the valve housing 40 there is axially movably supported a valve shaft 41 which is controlled by a spring 42, and which at its head end points towards the barrel mouth, and at its foot end is contacted by a valve stem 13 which stands in operative connection with the firing pin 11 of the firearm 1. The valve system 33, as such, is described in the applicant's co-pending German application Serial No. 195 42 332.1.

Figure 3:
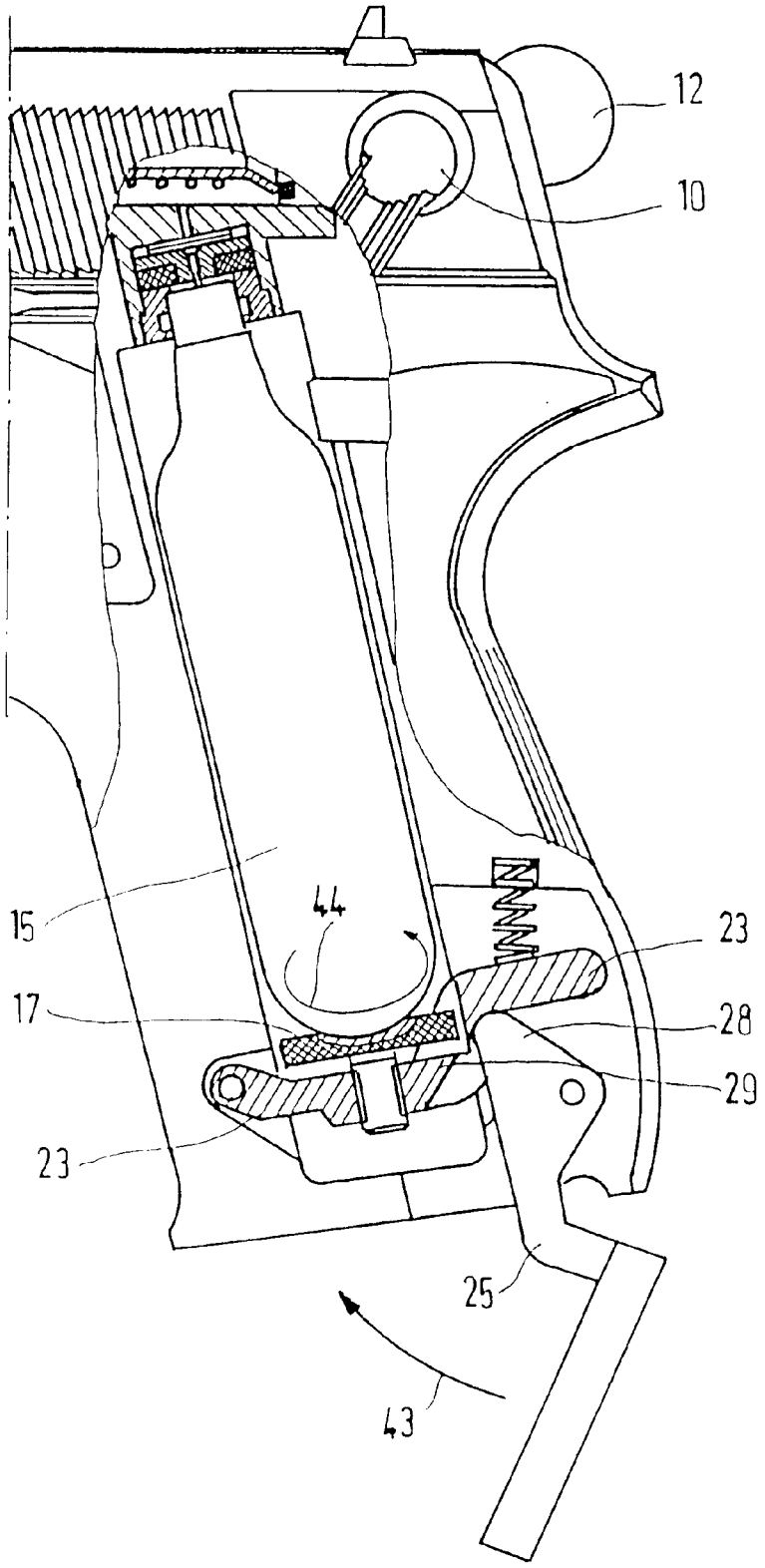
FIG. 3 illustrates relative inherent displacement of the abutment of FIG. 2, shown in cross-section.

When in the described manner, a gas capsule 15 is now inserted into the grip member 5 of the firearm 1, pursuant to FIG. 3 there is effected a pivoting back of the capsule tensioner 25 in the direction of arrow 43 into a first latched position, in which the short lever arm 28 of the capsule tensioner 25 engages into the transition from the inclined surface 29 into the horizontal bottom surface of the support element 23. In this position the abutment 17 with the knurled-head nut 20 lies in a somewhat right-angled position relative to the longitudinal axis of the gas capsule 15. When the knurled-head nut 20 is now rotated in the direction of arrow 44, the threaded pin 21 is resultingly turned out of the threaded bore of the support element 23. The abutment 17, up to contact with the bottom surface 16 of the gas capsule 15, thus carries out a relative movement in an axial direction towards the support element 23. This relative movement is continued until the capsule 15 is fully prestressed, and with its tip 31 lies against the piercing pin 32.

This first prestressing is protectively effected and with an opened grip cup 5, whereby the operator has at all times a good insight into the insertion and first prestressing procedure. The prestressing procedure serves for compensating any tolerances in the length of the capsule 15.

Figure 4:
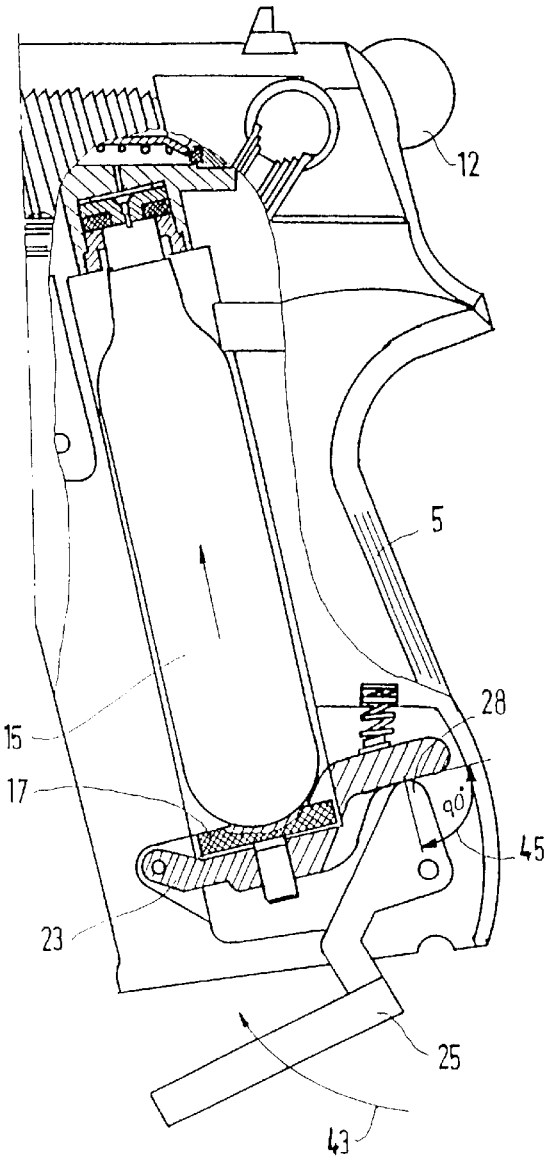
FIG. 4 illustrates the abutment pursuant to FIG. 2 in the piercing of the gas capsule, shown in cross-section.

The capsule tensioner 25, pursuant to FIG. 4, is pivoted further in the direction of arrow 43 and thereby achieves a maximum position in which there is present a right angle 45 between the horizontal bottom surface of the support element 23 and the vertical extending through the axial bolt 26 of the capsule tensioner 25. This vertical hereby extends in parallel with the longitudinal axis of the gas capsule 15. This is the highest position of the support element 23, and thereby of the abutment 17 which is concurrently carried along during this pivoting movement, and which has now undergone a superimposed external displacement relative to its inherent displacement. This is concurrently the piercing position in which the piercing needle 32 penetrates through the tip of the gas capsule 15, so that a gas which is under pressure can escape into the valve system 33, which is necessary for firing the shot. The seal 36 is hereby subjected to its maximum applied pressure.

Figure 5:
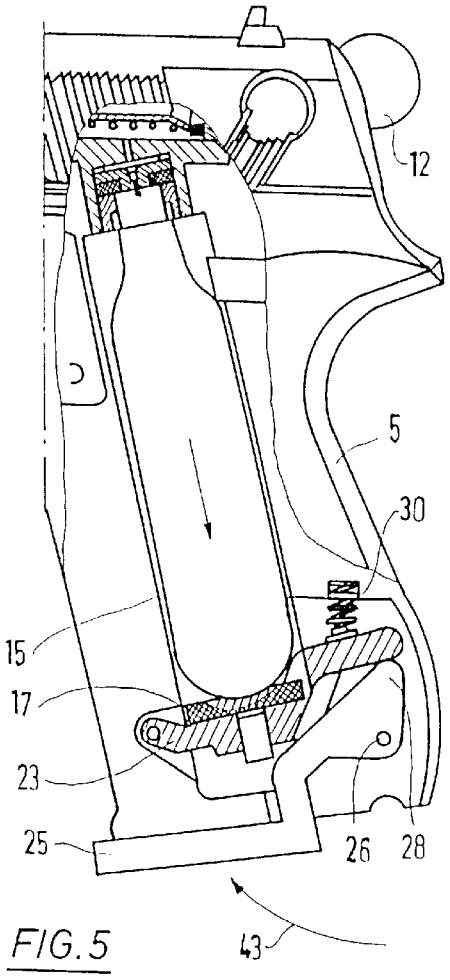
FIG. 5 illustrates the abutment of FIG. 2 in the closed final position, shown in cross-section.

The capsule tensioner 25 is further pivoted into its final position in the direction of arrow 43 (FIG. 5), in which it lies in its closing position against the bottom side of the grip member 5. In this position, the short lever arm 28 of the capsule tensioner 25 has passed over its dead-point position from FIG. 4. As a result, this will prevent an undesired and spontaneous opening of the capsule tensioner 25, and furthermore, the axial piercing pressure is taken away from the gas capsule 15. This is important, inasmuch as thereby the seal 36 in the valve system 33 and the relatively sensitive components of the valve system 33 are unstressed from any pressure, without that there is thereby encountered any gas leakage. The described path of unstressing is extremely short with a length of about 0.2 to 0.5 mm and is assumed by the seal 36.

Only after completion of the piercing and tensioning procedure is the grip cup or shell 6 again snapped into grip member 5.

We claim:

1. A compressed gas-operated firearm consisting of a pistol, including a weapon frame, a barrel connected to said weapon frame, a trigger system and a grip member fastened to said frame, a gas cartridge which is insertable into a chamber formed in the grip member so as to be in engagement with a valve system in the firearm for controlling gas emission from said gas cartridge responsive to the initiation of a shot through actuation of the trigger system, a closure arrangement for the chamber in the grip member consisting of a closure cover and an abutment acting on a bottom surface of the gas cartridge, wherein the abutment is separate from the closure arrangement and is constituted of an adjustment device of a displaceable element and of an adjustable element operating independently of the movement of the closure arrangement axially in a direction towards the bottom surface of the gas cartridge, and which are both independently movable relative to each other, the adjustable element being movable relative to the displaceable element which comprises a support element and acts directly and superimposingly on the gas cartridge, said support element being pivotable about an axis, and a spring imparting a biasing force to said support element opposite the pivotable motion thereof about said axis.

2. A compressed gas-operated firearm according to claim 1, wherein a screw connection provides an engagement between the adjustable element and the slidable element.

3. A compressed gas-operated firearm according to claim 1, wherein the abutment comprises a knurled-head screw having a head including receiving means on an end surface facing towards the gas cartridge, and a threaded shaft of said screw facing away therefrom is axially displaceably inserted into an associated threaded bore formed in the support element.

4. A compressed gas-operated firearm according to claim 1, wherein said support element is engaged by a tensioning device for said gas cartridge.

5. A compressed gas-operated firearm according to claim 4, wherein said tensioning device comprises a double-armed lever having one shorter lever arm which is in engagement with the support element and is movable through at least one interim position into a final installed position of a operationally-ready gas cartridge in said chamber, in which final position said shorter lever arm assumes an over-a-dead point position in which the support element is reset from an axially highest position relative to the gas cartridge in a direction towards the biasing action of the spring.

6. A compressed gas-operated firearm according to claim 5, wherein said support element possesses an open end section of stepped configuration which is in operative connection with the shorter lever arm of said cartridge tensioning device.

7. A compressed gas-operated firearm according to claim 1, wherein said abutment is arranged in the grip member of the firearm.

8. A compressed gas-operated firearm according to claim 7, wherein said grip member is closed by a grip cup which is unlatchable through the actuation of a knob on said grip cup.

* * * * *